US007372060B2

(12) United States Patent
Barnes et al.

(10) Patent No.: US 7,372,060 B2
(45) Date of Patent: May 13, 2008

(54) CONTAINER FOR FISSILE MATERIAL AND A METHOD OF MAKING THE SAME

(75) Inventors: John H Barnes, Derby (GB); Ronald I Kliene, Pavenham (GB)

(73) Assignee: Rolls-Royce plc, London (GB)

( * ) Notice: Subject to any disclaimer, the term of this patent is extended or adjusted under 35 U.S.C. 154(b) by 90 days.

(21) Appl. No.: 11/280,875

(22) Filed: Nov. 17, 2005

(65) Prior Publication Data

US 2008/0087849 A1 Apr. 17, 2008

Related U.S. Application Data

(63) Continuation of application No. PCT/GB2004/002104, filed on May 17, 2004.

(30) Foreign Application Priority Data

Jun. 12, 2003 (GB) ..... 0313581.1

(51) Int. Cl.
*B08B 9/08* (2006.01)

(52) U.S. Cl. ..... 250/506.1; 250/507.1; 220/565

(58) Field of Classification Search ..... 250/506.1, 250/507.1; 376/272, 173, 428; 220/565, 220/571, 469
See application file for complete search history.

(56) References Cited

U.S. PATENT DOCUMENTS 3,882,313 A 5/1975 Siemens
4,171,002 A * 10/1979 Smith ..... 134/166 R
4,343,426 A * 8/1982 Otsuka et al. ..... 228/170
4,470,950 A * 9/1984 Hyde ..... 376/272
4,972,087 A 11/1990 Neider et al.
5,265,133 A * 11/1993 Matthews ..... 376/272
5,333,752 A * 8/1994 Harding, Jr. ..... 220/565
5,533,648 A * 7/1996 Read et al. ..... 222/108

(Continued)

FOREIGN PATENT DOCUMENTS

GB 1 406 960 SP 9/1975

(Continued)

*Primary Examiner*—Nikita Wells
*Assistant Examiner*—Johnnie L Smith, II
(74) *Attorney, Agent, or Firm*—W. Warren Taltavull; Manelli Denison & Selter PLLC

(57) ABSTRACT

A container (10) for fissile material comprises an inner annular shaped receptacle (12) contained within an outer annular enclosure (14). The receptacle (12) and the enclosure (14) define an inner chamber (16) surrounded by an outer chamber (18). A closure mechanism (20) fastens the receptacle (12) to the enclosure (14) and seals there between. Two opposing openings (22) are provided in the top of the container (10) to allow fissile material to be introduced into and removed from the inner chamber (16). The openings (22) are shielded by flanges (24) and vented caps (23) seal the openings (22).

The annular container (10) is impact resistance. The outer chamber (18) acts as a buffer to protect the inner chamber (16). If the outer chamber (18) ruptures the fissile contents of the inner chamber (16) are contained. The outer chamber (18) also acts to contain any spillage of the fissile material in the event that the inner receptacle (12) fails.

22 Claims, 5 Drawing Sheets

U.S. PATENT DOCUMENTS

| | | | | |
|---|---|---|---|---|
| 5,749,500 | A * | 5/1998 | Kraus et al. | 222/377 |
| D423,638 | S * | 4/2000 | Drewery | D23/202 |
| D424,659 | S * | 5/2000 | Drewery | D23/202 |
| D426,866 | S * | 6/2000 | Drewery | D23/207 |
| 6,318,581 | B1 * | 11/2001 | Garton | 220/565 |
| 6,474,496 | B1 * | 11/2002 | Garton | 220/565 |

FOREIGN PATENT DOCUMENTS

| | | |
|---|---|---|
| GB | 2 177 149 A | 1/1987 |
| GB | 2 251 021 A | 6/1992 |
| JP | 2001051095 AB | 2/2001 |

* cited by examiner

CONTAINER FOR FISSILE MATERIAL AND A METHOD OF MAKING THE SAME

This is a Continuation of International Appln. No. PCT/GB2004/002104 filed May 17, 2004 which designating the U.S.

FIELD OF THE INVENTION

The present invention relates to a container suitable for storing and transporting fissile material and to a method of producing such a container.

BACKGROUND OF THE INVENTION

Containers are known for the storage of fissile material and these containers must store the fissile material as safely as possible. The fissile material is therefore mixed with acid and stored as liquor in the containers. The acid in the liquor acts to moderate the fissile material and the mass of fissile material stored in the container must be limited. If too much fissile material is stored in a given container then the liquor can become critical releasing harmful radiation. Accidents have occurred when operators have stored too much fissile material in a given container.

To prevent accidents with the fissile contents of the containers the geometry of the containers is controlled. Certain shapes of containers are used in the industry, which prevent or reduce the risk of the liquor becoming critical. These geometries are known as favorable geometries.

Containers with a favorable geometry are used for the storage of fissile liquor at processing facilities. However, as storage space diminishes at the facilities it has become necessary to transport the material within the facility. The containers used to transport the liquor must have a favorable geometry and be resistant to impacts.

SUMMARY OF THE INVENTION

The present invention seeks to provide an improved container, which is suitable for the storage of fissile material and is also impact resistant so that the fissile material can be transported in the container.

According to the present invention a container for a fissile material comprises an annular vessel having a plurality of walls therein to define an inner and an outer annular chamber, the outer annular chamber surrounds the inner annular chamber and at least one sealable opening is provided to allow for the introduction and removal of fissile material into the inner annular chamber.

According to a further aspect of the present invention a container for fissile material comprises a first and a second annular vessel, the first annular vessel having larger diameters than the second annular vessel, the second annular vessel being located within the first annular vessel to define an inner and an outer annular chamber, the outer chamber surrounds the inner chamber and at least one sealable opening is provided to allow for the introduction and removal of fissile material into the inner annular chamber.

The provision of two annular chambers within the container renders it impact resistant. The outer annular chamber encloses and protects the inner annular chamber in which the fissile material is stored.

For ease of manufacture the container may comprise two annular vessels. The two annular vessels may be provided with flanges, which engage to locate the first and second annular vessels relative to one another. Preferably the flanges are circumferential and are held in engagement by a closure mechanism.

In the preferred embodiment of the present invention the closure mechanism includes a seal to prevent any leakage of the fissile material. The closure mechanism may extend around the sealable openings and this portion is threaded to allow for the location of a sealing cap. Preferably the sealing cap is vented.

A plurality of sealable openings may be provided to allow for the introduction and removal of the fissile material into the inner annular chamber. In the preferred embodiment of the present invention two diametrically opposed sealable openings are provided. The fissile material is thoroughly mixed as it is introduced through multiple openings in the inner annular chamber. Agitators may also be inserted through these openings to further mix the liquor stored within the inner annular chamber.

In the preferred embodiment of the present invention further raised flanges are provided adjacent the sealable openings. The flange acts to protect the sealable openings by absorbing any impacts.

Preferably the flanges are an integral part of the closure mechanism and handholds may be provided therein to allow the container to be lifted.

Channels may be provided in outer surfaces of the vessel to allow for the drainage of fissile material. Ribs may also be provided on the surfaces of the annular vessels and/or the walls to reinforce the container.

A method of manufacturing a container for fissile material comprises the steps of, manufacturing a first and a second annular vessel, the first annular vessel having larger diameters than the second annular vessel, nesting the second annular vessel within the first annular vessel, locking the first and the second annular vessels together and producing a sealable opening in the second annular vessel.

Preferably the first and the second annular vessels are molded from polyethylene. A technique known as rotational molding may be used to produce the vessels.

BRIEF DESCRIPTION OF THE DRAWINGS

The present invention will now be described with reference to the accompanying figures in which.

DETAILED DESCRIPTION OF THE INVENTION

Figure 1:
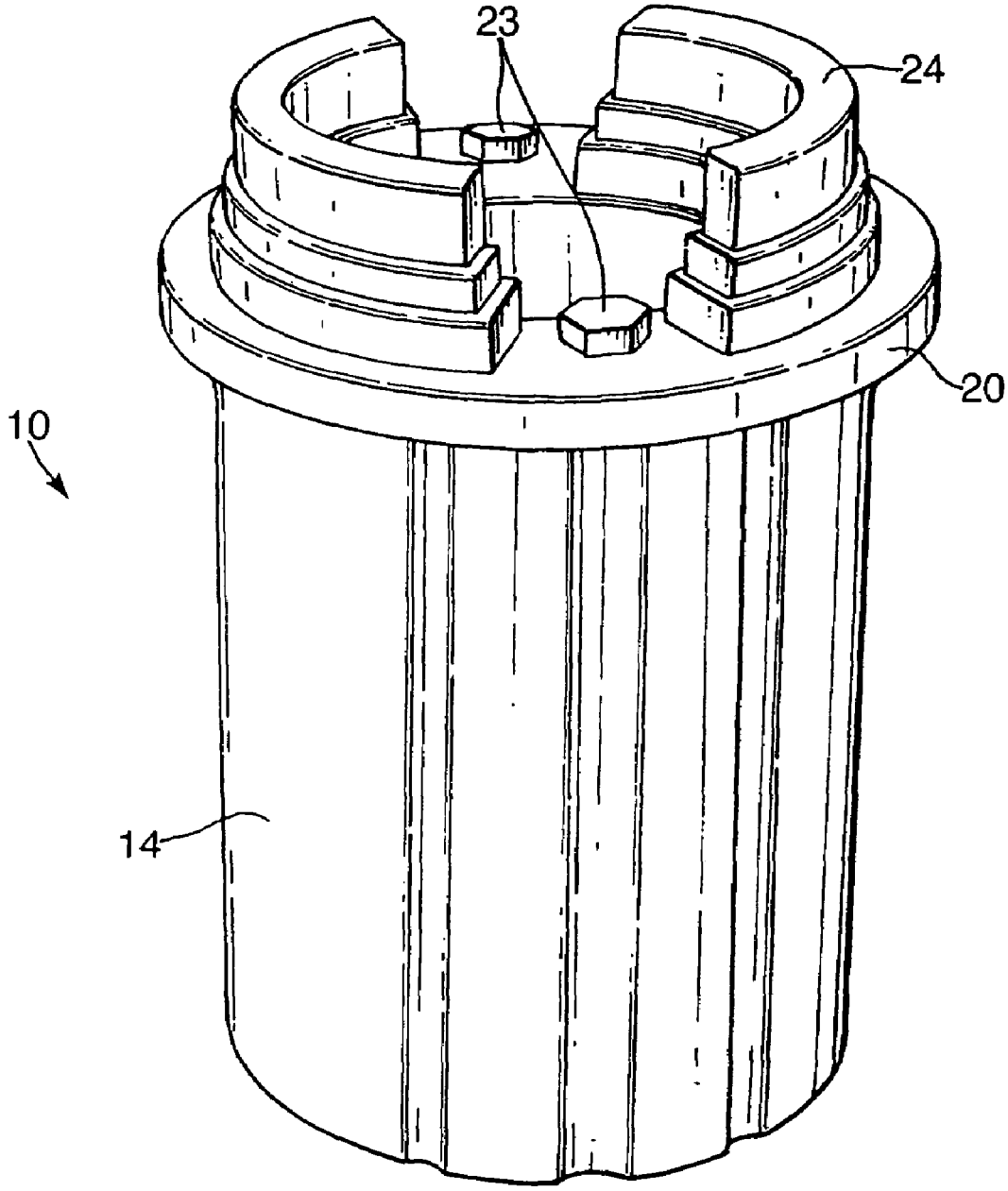
FIG. 1 is a pictorial view of a container in accordance with the present invention.
Figure 2:
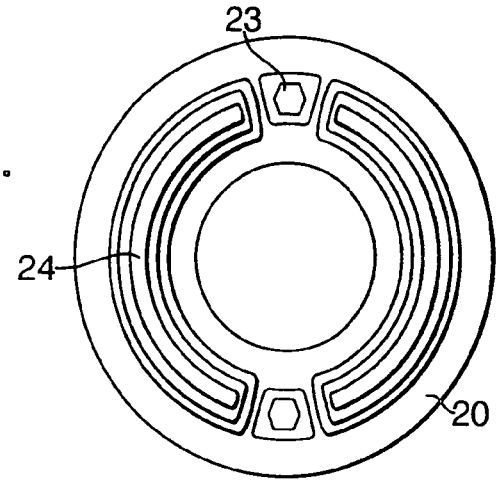
FIG. 2 is a view of the top of the container shown in FIG. 1.
Figure 5:
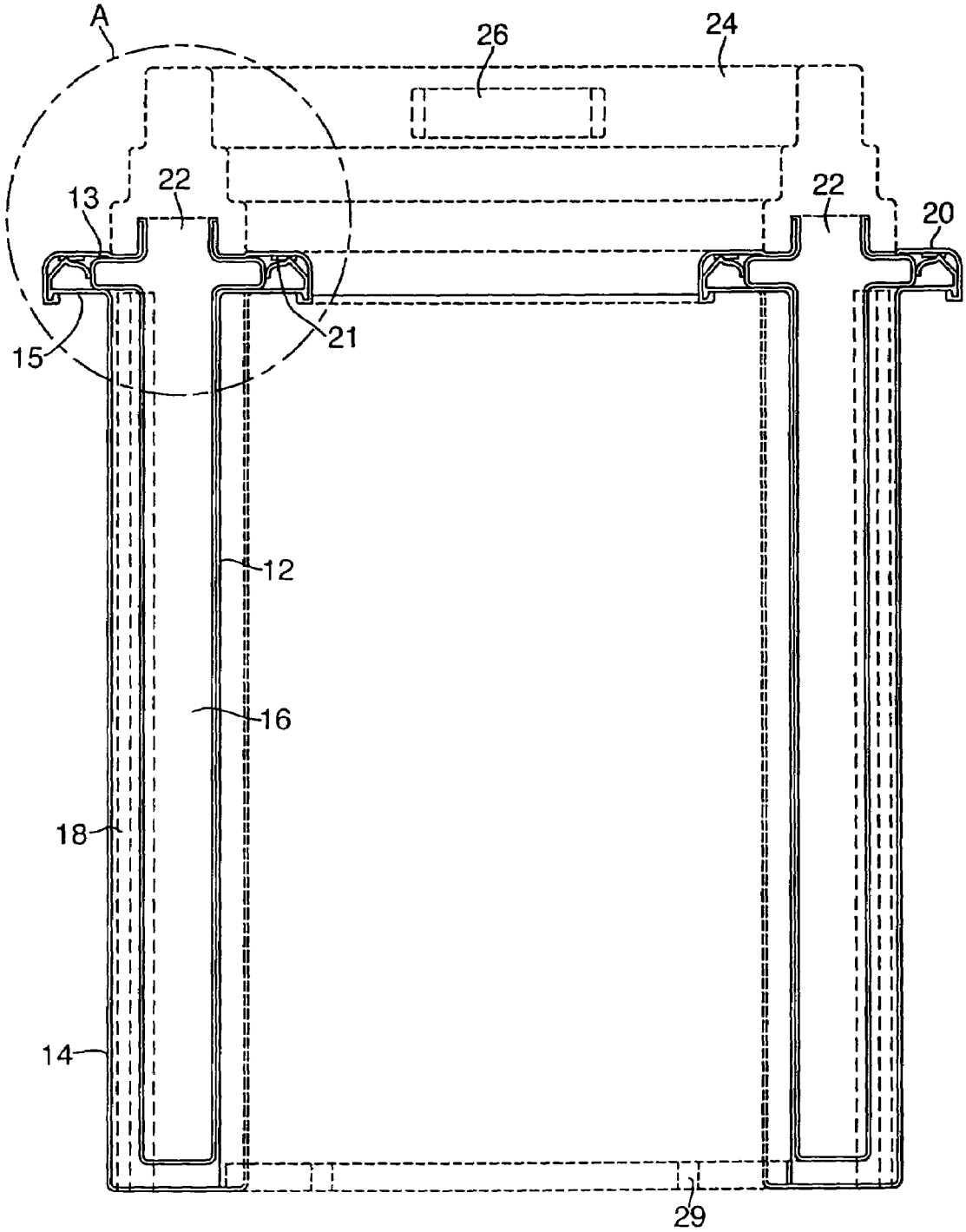
FIG. 5 is a cross-sectional view of a container in accordance with the present invention.

Referring to FIG. 1 a container 10 comprises an annular vessel. The vessel consists of an inner annular shaped receptacle 12 contained within an outer annular enclosure 14, FIG. 5. The receptacle 12 and the enclosure 14 define an inner chamber 16 surrounded by an outer chamber 18. A closure mechanism 20 is provided which fastens the receptacle 12 to the enclosure 14 and seals therebetween.

Two diametrically opposed openings 22 are provided in the top of the container 10. The openings 22 allow fissile material in the form of a liquor to be introduced into and removed from the inner chamber 16. Agitators may be inserted though the openings 22 to mix the fissile contents of the container. The use of multiple openings 22 also ensures that the fissile material is mixed thoroughly as it is introduced into the container 10. Vented caps 23 seal the openings 22, FIG. 1.

The container 10 is impact resistant. The outer chamber 18 acts as a buffer to protect the inner chamber 16. If the outer chamber 18 ruptures the fissile contents of the inner chamber 16 are contained. The outer chamber 18 also acts to contain any spillage of the fissile material in the event that the inner receptacle 12 fails.

To protect the openings 22 from impact damage the top of the container 10 is provided with two upstanding flanges 24. The flanges 24 extend circumferential around the top of the container 10 and shield the openings 22. The flanges 24 are formed from a series of steps, which in the event of a collision are designed to crumple. The flanges 24 are also provided with apertures 26, which act as hand holds so that the container 10 can be lifted.

In the preferred embodiment of the present invention the container 10 is manufactured by molding the inner receptacle 12 and the outer enclosure 14 from linear medium density polyethylene. It will however be appreciated by one skilled in the art that other materials may be used provided that they are resistant to the liquor, not degradable and are impact resistant.

Figure 7:
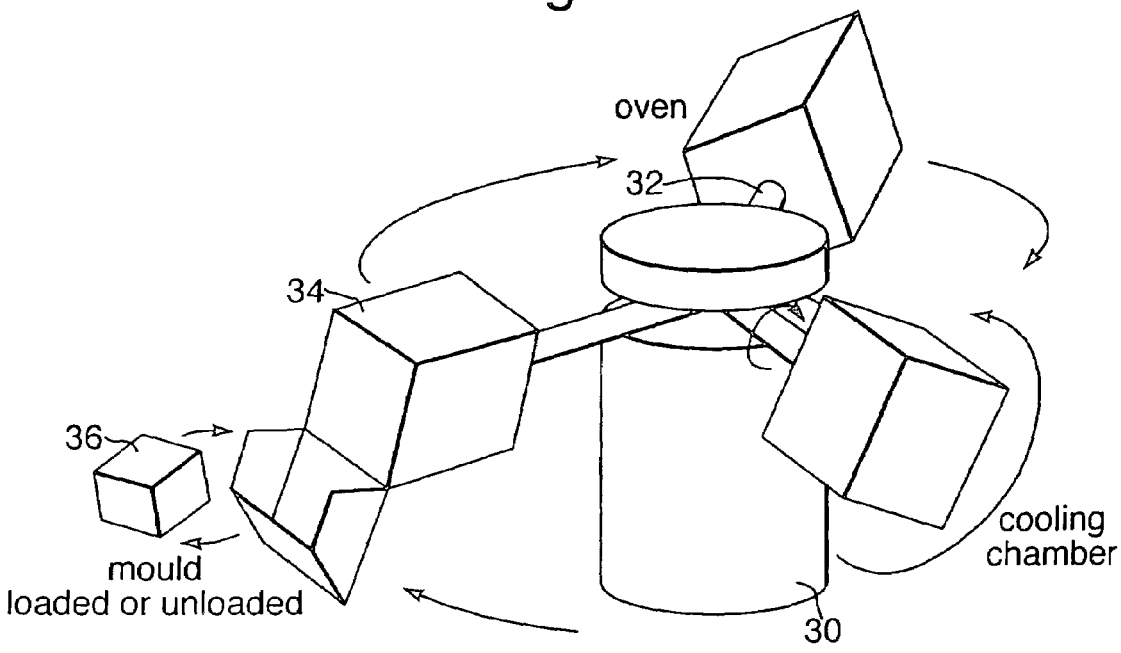
FIG. 7 is a schematic view of the equipment used to manufacture containers in accordance with the present invention.

FIG. 7 shows a typical rotating carousel 30 used to mold the inner receptacle 12 and the outer enclosure 14. The carousel has spindle arms 32 each supporting a carrier 34 holding one or more molds 36. The main spindles 32 rotate about a horizontal axis whilst the carriers 34 rotate about a vertical axis.

A measured weight of thermoplastic powder is placed inside a cold mold 36, which moves into an oven. The mold 36 is heated to 230-400° C. and is rotated slowly in two directions. As the mold 36 rotates a polymer coating forms over the inner surfaces of the mold 36. The speed ratio between the two revolving axes is calculated according to the shape of the mold 36 and the cycle length varies from three minutes to one hour depending on the wall thickness. Still rotating the mold 36 passes into a cooling chamber and is cooled by air or water jets (not shown). The molding can be removed as soon as it can hold its shape.

The advantage of producing components by rotational molding is that they are virtually stress free, as they do not have to withstand high pressures as in injection of blow molding. The inner receptacle 12 and the outer enclosure 14 are thus less likely to suffer stress cracking when in use when compared to components molded using high-pressure processes.

Figure 6:
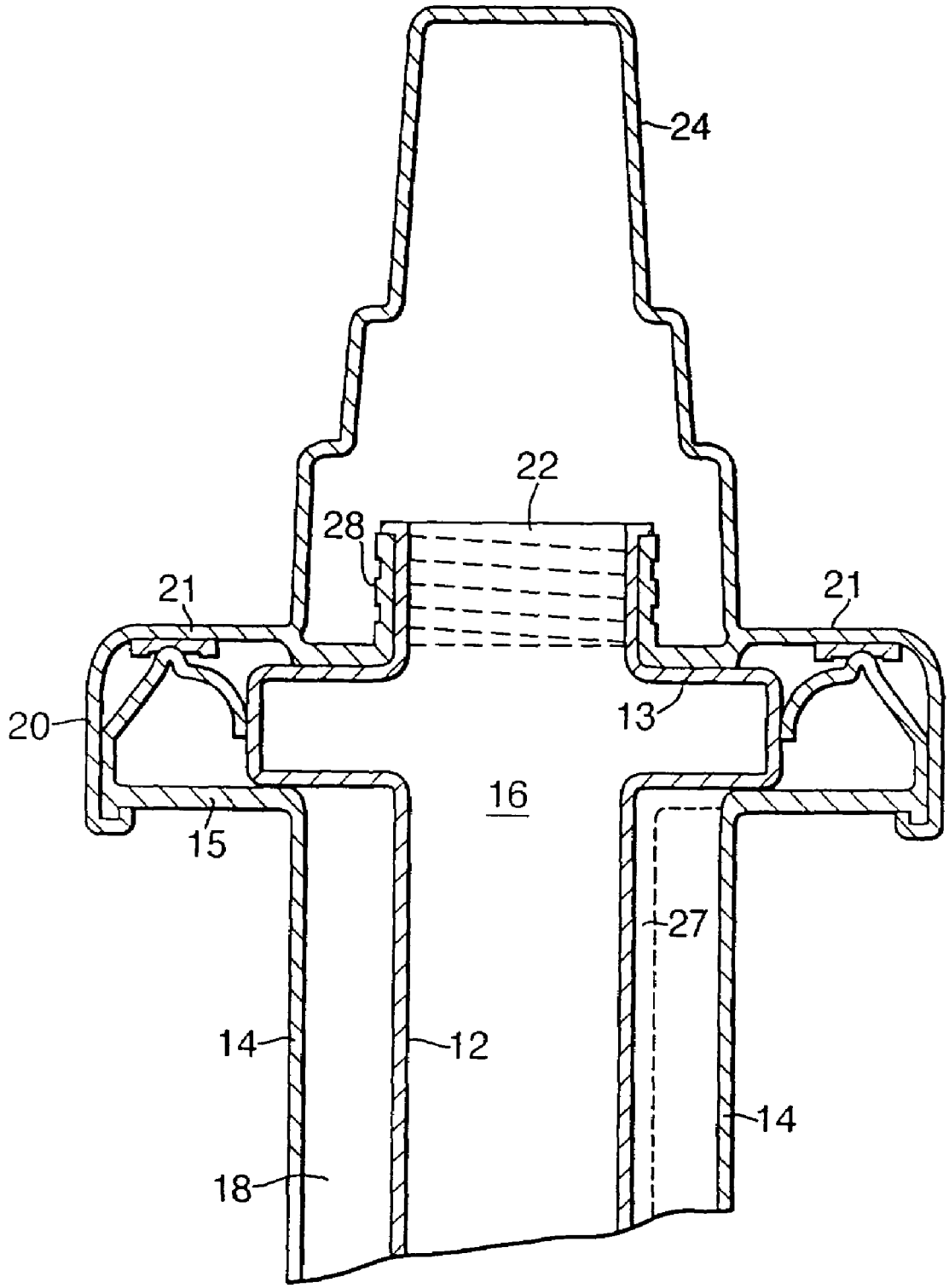
FIG. 6 is an enlarged cross-sectional view of part of the locking mechanism in region A of FIG. 5.

Once molded the inner annular receptacle 12 is nested within the outer annular enclosure 14. A molded flange 13 is provided on the inner receptacle 12, FIG. 6. The molded flange 13 engages with a corresponding molded flange 15 on the outer enclosure 14. The flanges 13 and 15 locate the receptacle 12 and the enclosure 14 relative to one another. A closure mechanism 20, which is also molded from linear medium density polyethylene, passes over the flanges 13 and 15 to hold them in engagement and lock the inner receptacle 12 and the outer enclosure 14 together. A neoprene seal 21 is located between the closure mechanism 20 and the molded flange 15 on the outer enclosure 14 to prevent spillage. The closure mechanism 20 has an upstanding treaded portion 28 that locate the vented caps 23 onto the openings 22. The upstanding flanges 24, which protect the openings 22 are also formed as an integral part of the closure mechanism 20.

Figure 3:
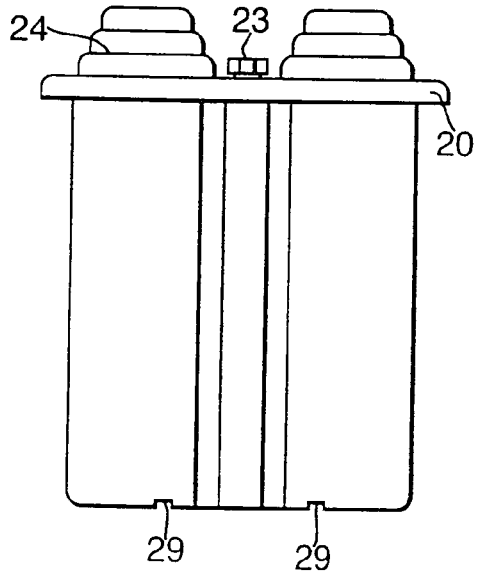
FIG. 3 is a view of the front of the container shown in FIG. 1.
Figure 4:
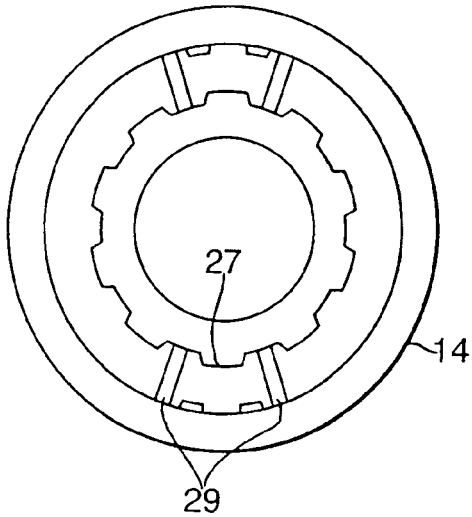
FIG. 4 is a view of the base of the container shown in FIG. 1.

Channels 29 are provided in the base of the container 10, FIG. 3. If fissile material is accidentally spilt into the center of the container the channels 29 allow it to drain out.

Whilst in the preferred embodiment of the present invention the container is constructed from two annular vessels, the inner receptacle 12 and the outer enclosure 14, it will be appreciated that one annular vessel may be used having internal walls that define the inner 16 and outer 18 chambers. Ribs 27 may be provided on the surfaces of the annular vessels and/or the internal walls to reinforce the container.

We claim:

1. A container for fissile material comprising an annular vessel, characterized in that a plurality of walls are provided within the annular vessel to define adjacent inner and outer annular chambers, the outer annular chamber surrounding the inner annular chamber and at least one sealable opening being provided to allow for the introduction and removal of the fissile material into the inner annular chamber where said outer annular chamber acts to contain the fissile material in the event of a failure of the inner annular chamber.

2. A container for fissile material comprising a first and a second annular vessel, the first annular vessel having an outer diameter larger than the diameter of said second annular vessel, characterized in that the second annular vessel is located within the first annular vessel to define adjacent inner and outer annular chambers, the outer annular chamber surrounds the inner annular chamber and at least one sealable opening is provided to allow for the introduction and removal of the fissile material into the inner annular chamber where said outer annular chamber acts to contain the fissile material in the event of a failure of the inner annular chamber.

3. A container as claimed in claim 2 characterized in that the first and the second annular vessels are provided with flanges that engage to locate the vessels relative to one another.

4. A container as claimed in claim 3 characterized in that the flanges are circumferential.

5. A container as claimed in claim 3 characterized in that the flanges are held in engagement by a closure mechanism.

6. A container as claimed in claim 5 characterized in that the closure mechanism includes a seal.

7. A container as claimed in claim 5 characterized in that the closure mechanism extends around the sealable openings.

8. A container as claimed in claim 7, characterized in that the portion of the closure mechanism that extends around the sealable opening is threaded to allow for the location of a sealing cap.

9. A container as claimed in claim 8 characterized in that the cap is vented.

10. A container as claimed in claim 1 characterized in that a plurality of sealable openings are provided to allow the introduction and removal of fissile material into the inner annular chamber.

11. A container as claimed in claim 10 characterized in that two diametrically opposed openings are provided.

12. A container as claimed in claim 8 characterized in that further raised flanges are provided adjacent the sealable openings.

13. A container as claimed in claim 12 characterized in that the further raised flanges are an integral part of the closure mechanism.

14. A container as claimed in claim 12 characterized in that the further raised flanges have apertures therein.

15. A container as claimed in claim 1 characterized in that channels are provided in the outer surfaces of the annular vessel.

16. A container as claimed in claim 1 characterized in that ribs are provided on the annular vessels and/or the internal walls.

17. A container as claimed in claim 1 characterized in that it is made from polyethylene.

18. A container as claimed in claim 1 characterized in that it is made by molding.

19. A method of manufacturing a container for fissile material comprises the steps of the, manufacturing a first and a second annular vessel, the first vessel having an outer diameter larger than the diameter of said second vessel, characterized in that the second annular vessel is nested within the first annular vessel, to define adjacent inner and outer annular chambers, locking the first and the second annular vessels together and producing sealable openings into the second annular vessel which allow for the introduction and removal of the fissile material.

20. A method as claimed in claim 19 characterized in that the first and second annular vessels are molded.

21. A method as claimed in claim 20 characterized in that the first and second vessels are molded using rotational molding.

22. A method as claimed in claim 19 characterized in that the first and second annular vessels are molded from polyethylene.

* * * * *